US010859074B2

(12) United States Patent
Govyadinov

(10) Patent No.: US 10,859,074 B2
(45) Date of Patent: Dec. 8, 2020

(54) MICROFLUIDIC DEVICES

(71) Applicant: HEWLETT-PACKARD DEVELOPMENT COMPANY, L.P., Houston, TX (US)

(72) Inventor: Alexander Govyadinov, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 38 days.

(21) Appl. No.: 16/094,433

(22) PCT Filed: Jul. 22, 2016

(86) PCT No.: PCT/US2016/043528
§ 371 (c)(1),
(2) Date: Oct. 17, 2018

(87) PCT Pub. No.: WO2018/017120
PCT Pub. Date: Jan. 25, 2018

(65) Prior Publication Data

US 2019/0128248 A1 May 2, 2019

(51) Int. Cl.
*F04B 19/00* (2006.01)
*F04B 19/04* (2006.01)
(Continued)

(52) U.S. Cl.
CPC ..... *F04B 19/04* (2013.01); *B01L 3/50273* (2013.01); *F04B 17/00* (2013.01);
(Continued)

(58) Field of Classification Search
CPC ..... F04B 19/04; F04B 19/24; F04B 19/006; F04B 17/00; F04B 17/03; F04B 17/003;
(Continued)

(56) References Cited

U.S. PATENT DOCUMENTS 6,010,316 A * 1/2000 Haller ..... B01L 3/50273 366/DIG. 4
6,655,924 B2 * 12/2003 Ma ..... F04B 19/24 417/209
8,814,293 B2 8/2014 Strunk
9,090,084 B2 * 7/2015 Govyadinov ..... B41J 2/1404
(Continued)

FOREIGN PATENT DOCUMENTS

TW 200739075 10/2007
WO WO-2015116068 A1 8/2015
WO WO-2016024998 A1 2/2016

OTHER PUBLICATIONS

Srivannavi; "Microfluidic Reactor Array Device for Massively Parallel In-situ Synthesis of Oligonucleotides"; Sens Actuators B Chem.; Jul. 2009; pp. 473-481.
(Continued)

*Primary Examiner* — Charles G Freay
(74) *Attorney, Agent, or Firm* — Fabian VanCott

(57) ABSTRACT

According to an example, a microfluidic device may include a transport channel having an inlet and an outlet and a plurality of pump loops extending along the transport channel. Each of the plurality of pump loops may include a first branch, a second branch, and a connecting section connecting the first branch and the second branch. The first branch may include a first opening and the second branch may include a second opening, in which the first opening and the second opening are in direct fluid communication with the transport channel. The pump loops may also each include an actuator positioned in the first branch, in which the actuators in the pump loops are to be activated to induce a traveling wave that is to transport the fluid through the transport channel from the inlet to the outlet.

20 Claims, 4 Drawing Sheets

(51) Int. Cl.

| | |
|---|---|
| ***F04B 17/00*** | (2006.01) |
| ***F04B 17/03*** | (2006.01) |
| ***F04B 19/24*** | (2006.01) |
| ***B01L 3/00*** | (2006.01) |

(52) U.S. Cl.
CPC ..... *F04B 17/003* (2013.01); *F04B 17/03* (2013.01); *F04B 19/006* (2013.01); *F04B 19/24* (2013.01); *B01L 2300/088* (2013.01); *B01L 2400/0439* (2013.01); *B01L 2400/0442* (2013.01); *B01L 2400/0496* (2013.01); *B01L 2400/086* (2013.01)

(58) Field of Classification Search
CPC ..... B01L 3/50273; B01L 2400/086; B01L 2400/0496; B01L 2400/0442; B01L 2400/043; B01L 2300/088
See application file for complete search history.

(56) References Cited

U.S. PATENT DOCUMENTS

| | | | | |
|---|---|---|---|---|
| 9,283,590 | B2 | 3/2016 | Govyadinov et al. | |
| 2008/0000833 | A1 | 1/2008 | Peters | |
| 2013/0155152 | A1 | 6/2013 | Govyadinov et al. | |
| 2014/0220617 | A1 | 8/2014 | Yung et al. | |
| 2014/0377145 | A1* | 12/2014 | Govyadinov ..... | B01F 13/0059 422/505 |
| 2015/0085021 | A1 | 3/2015 | Govyadinov et al. | |
| 2015/0260181 | A1 | 9/2015 | Harvey | |

OTHER PUBLICATIONS

Studer; "An Integrated AC Electrokinetic Pump in a Microfluidic Loop for Fast and Tunable Flow Control"; Analyst; Aug. 9, 2004; pp. 944-949.

* cited by examiner

MICROFLUIDIC DEVICES

BACKGROUND

Microfluidics applies across a variety of disciplines including engineering, physics, chemistry, microtechnology and biotechnology. Microfluidics involves the study of small volumes, e.g., microliters, picoliters, or nanoliters, of fluid and how to manipulate, control and use such small volumes of fluid in various microfluidic systems and devices such as microfluidic devices or chips. For example, microfluidic biochips (which may also be referred to as "lab-on-chip") are used in the field of molecular biology to integrate assay operations for purposes such as analyzing enzymes and DNA, detecting biochemical toxins and pathogens, diagnosing diseases, etc.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
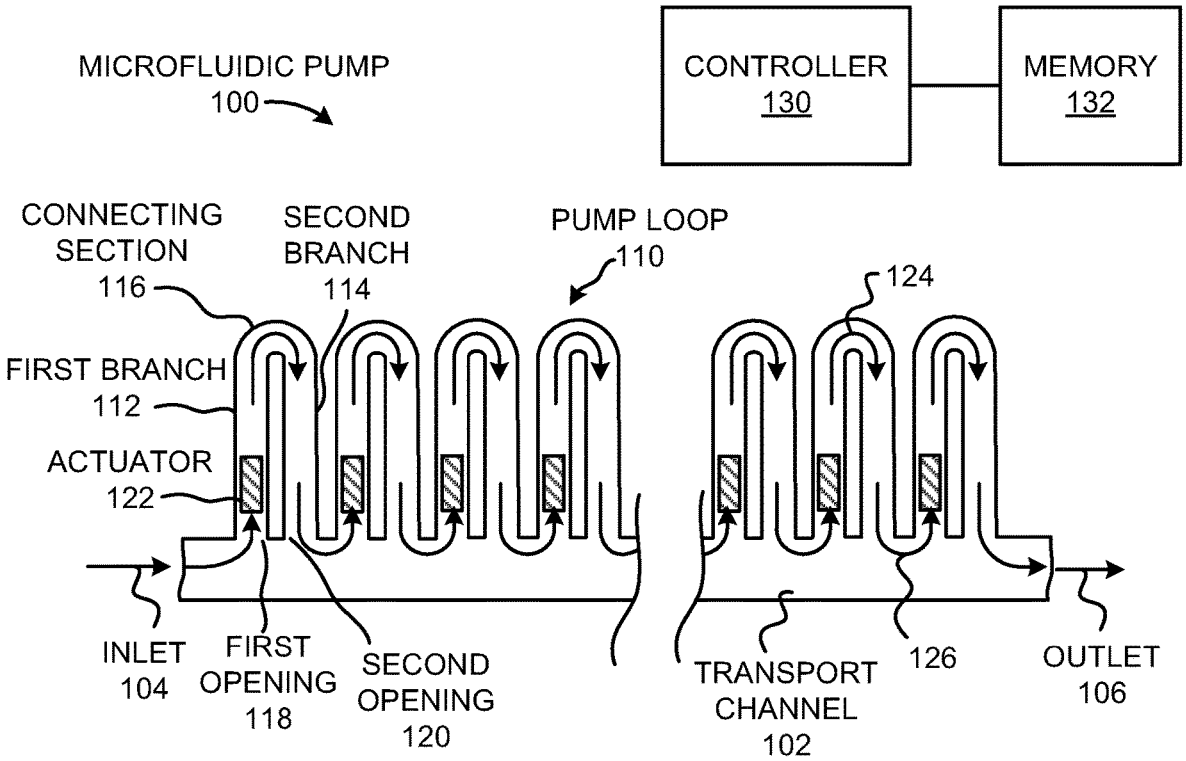
FIG. 1 depicts a simplified block diagram of an example microfluidic pump.

For simplicity and illustrative purposes, the present disclosure is described by referring mainly to an example thereof. In the following description, numerous specific details are set forth in order to provide a thorough understanding of the present disclosure. It will be readily apparent, however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Additionally, it should be understood that the elements depicted in the accompanying figures may include additional components and that some of the components described in those figures may be removed and/or modified without departing from scopes of the elements disclosed herein. It should also be understood that the elements depicted in the figures may not be drawn to scale and thus, the elements may have different sizes and/or configurations other than as shown in the figures.

Disclosed herein are microfluidic devices, which may also be referenced as pumps, that include a transport channel and a plurality of pump loops extending along the transport channel. The pump loops may each include two openings that are in fluid communication with the transport channel and fluid may flow between the pump loops and the transport channel through the openings. An actuator may be positioned in each of the pump loops such that activation of the actuators may induce an analogue of a traveling wave that is to cause the fluid to flow through the transport channel and the pump loops from one direction to another direction. A traveling wave may be defined as a wave in which the fluid moves in the direction of propagation, and, thus, the movement of the fluid through the pump loops and the transport channel may be similar to the movement of a traveling wave. Although the movement of the fluid through the pump loops and the transport channel may be analogous to a traveling wave, the movement is described herein as a traveling wave. As also discussed herein, various features may be incorporated into the microfluidic pumps to facilitate transport of the fluid through the microfluidic pumps.

Through implementation of the microfluidic devices (pumps) and methods disclosed herein, fluid may be conveyed or transported through microfluidic channels in a relatively simple and efficient manner. That is, the traveling wave induced by the actuators in the pump loops may enable transport of the fluid through relatively long distances without differential pressure in the microfluidic channels. In addition, the microfluidic pumps disclosed herein may enable the fluid to be transported through microfluidic channels without requiring complicated designs or external pumps.

With reference first to FIG. 1, there is shown a simplified block diagram of an example microfluidic pump 100. It should be understood that the microfluidic pump 100 depicted in FIG. 1 may include additional components and that some of the components described herein may be removed and/or modified without departing from a scope of the microfluidic pump 100 disclosed herein. The microfluidic pump 100 is also referenced herein as a microfluidic transporting device.

The microfluidic pump 100 is depicted as including a transport channel 102, which may include an inlet 104 and an outlet 106. Generally speaking, the microfluidic pump 100 may receive a fluid at the inlet 104 and may transport the fluid to the outlet 106 of the transport channel 102. For instance, the microfluidic pump 100 may receive the fluid from a fluid source at the inlet 104 and may transport the fluid to a testing location positioned at the outlet 106. As discussed in greater detail herein, the microfluidic pump 100 may transport the fluid through formation of a traveling wave through the microfluidic pump 100. Particularly, the traveling wave may be formed through a plurality of pump loops 110 that may extend along the transport channel 102. The pump loops 110 are depicted in FIG. 1 as extending the entire distance along the transport channel 102 between the inlet 104 and the outlet 106.

Each of the pump loops 110 may include a first branch 112, a second branch 114, and a connecting section 116. As shown, the connecting section 116 may have a U-shape and may be connected to both the first branch 112 and the second branch 114. In addition, the first branch 112 may include a first opening 118 through which fluid may be received into the first branch 112 and a second opening 120 through which fluid may be expelled from the second branch 114. According to an example, the transport channel 102 and the pump loops 110 may be formed in a silicon material, an epoxy-based negative photoresist (such as SU-8), or the like, through any suitable microfabrication process.

An actuator 122, which is also referenced herein as a pump, is depicted as being positioned in a respective first branch 112. Thus, for instance, fluid from the transport channel 102 may be delivered into the first branches 112 through the first openings 118 and may flow over the actuators 122. The actuators 122 may facilitate flow of the fluid through the pump loops 110 through application of pressure on the fluid contained in the respective pump loops 110. For instance, the actuators 122 may cause a traveling wave to be induced in the fluid to cause the fluid to flow through the pump loops 110. In one example, the actuators 122 are resistors that, when activated (by, for example, a thin film transistor), are to generate sufficient heat to vaporize fluid around the resistors, creating bubbles that forcefully push fluid through the pump loops 110 as shown by the arrows 124. In one implementation, the actuator 122 may be a thermoresistive element which may employ a thermal resistor formed on an oxide layer on a top surface of a substrate and a thin film stack applied on top of the oxide layer, in which the thin film stack includes a metal layer defining the thermoresitive element, conductive traces and a passivation layer.

In another implementation, the actuators 122 may be piezoelectric elements, in which electrical current may selectively be applied to a piezoelectric member (by, for example, a field effect transistor) to deflect a diaphragm that forcefully pushes fluid through the pump loops 110 as shown by the arrows 124. In yet other implementations, the actuators 122 may be other forms of presently available or future developed actuators such as electrostatic driven membranes, electro-hydrodynamic pulse pumps, magneto-strictive and the like displacement devices.

In any of the implementations discussed herein, activation of the actuators 122 may cause fluid to be expelled from the pump loops 110 through the second opening 120. In addition, activation of the actuators 122 may cause fluid to be drawn into the pump loops 110 through the first openings 118 as shown by the arrows 126. Thus, by selectively activating the actuators 122, e.g., in a sequential arrangement, fluid that is initially received through the inlet 104 may be conveyed or transported through the pump loops 110 to the outlet 106. In other words, the fluid may be conveyed by a wave through the pump loops 110. According to an example, to ensure that the fluid flows through the pump loops 110 from the inlet 104 to the outlet 106 of the transport channel, the pump loops 110 may be enclosed except for the first opening 118 and the second opening 120. That is, none of the pump loops 110 may include a nozzle through which fluid may be ejected from the microfluidic pump 100.

According to an example, the pump loops 110 have cross sectional areas of between about 100×50 $\mu m^2$ to about 200×100 $\mu m^2$. In another example, the pump loops 110 may have diameters/dimensions that are between about 10 μm and about 500 μm. The term "about" may be defined to mean±2 μm to ±100 μm. In other examples, the cross sectional areas may vary outside of this range. The cross sectional area of the transport channel 102 may larger than the cross sectional areas of the pump loops 110. For instance, the cross sectional area may be between about 200×50 $\mu m^2$ to about 500×100 $\mu m^2$. Thus, for instance, the transport channel 102 may be relatively shallow and comparable with the depths of the pump loops 110 or significantly deeper than the pump loops 110.

Also shown in FIG. 1 is a controller 130 that may control activation of the actuators 122 and a memory 132 on which may be stored instructions for the controller 130. Although not shown, the controller 130 may be electrically connected to each of the actuators 122. The controller 130 may control when the actuators 122 are activated through the electrical connection. The controller 130 may be integrated with the microfluidic pump 100, e.g., may be provided on a common chassis as the microfluidic pump 100. In another example, the controller 130 may be separate from the microfluidic pump 100 and may be connected to the chassis of the microfluidic pump 100 through a wired or wireless connection. In the latter example, the controller 130 may be a controller, e.g., cpu, of a computing device such as a smartphone, a tablet computer, a laptop computer, a desktop computer, or the like.

The controller 130 may include a processing unit or multiple processing units that may generate control signals directing the operations of the actuators 122. For purposes of the present disclosure, the term "processing unit" shall mean a presently developed or future developed device that executes sequences of instructions contained in memory. Execution of the sequences of instructions may cause the processing unit to perform steps such as generating control signals. The instructions may be loaded in a random access memory (RAM) for execution by the processing unit from a read only memory (ROM), a mass storage device, or some other persistent storage. In other examples, hard wired circuitry may be used in place of or in combination with software instructions to implement the functions described. For example, controller 130 may be embodied as part of an application-specific integrated circuit (ASIC). Unless otherwise specifically noted, the controller is not limited to any specific combination of hardware circuitry and software, nor to any particular source for the instructions executed by the processing unit.

The controller 130 may carry out or execute instructions contained in the memory 132. In operation, the controller 130 may execute instructions to generate control signals for the actuators 122 to cause the actuators 122 to be activated. For instance, the controller 130 may generate control signals for the actuators 122 to be activated in a predetermined order that is to cause fluid to be transported from the inlet 104 to the outlet 106. According to an example, the actuators 122 may be grouped into primitives such that groups of the actuators 122 may be controlled by the same control signals. In this example, each of the primitives may include anywhere between about 3 to about 16 actuators. In an example in which the actuators 122 are grouped into primitives of four actuators, a first primitive may include a first actuator, a fifth actuator, a ninth actuator, etc., a second primitive may include a second actuator, a sixth actuator, a tenth actuator, etc., along the extent of the transport channel 102. In this example, the actuators 122 may be grouped into one of four different primitives and the controller 130 may output four different control signals to control all of the actuators 122.

In addition, the controller 130 may output the control signals to activate the actuators 122 according to the primitives to which they are grouped. That is, for instance, the controller 130 may activate the actuators 122 in the first primitive at a first time, the actuators 122 in the second primitive at a second time, the actuators 122 in the third primitive at a third time, and the actuators 122 in the fourth primitive at a fourth time. The controller 130 may also repeat this activation sequence to sequentially activate the actuators 122 according to the primitives to which they actuators 122 are assigned.

Figure 2A:
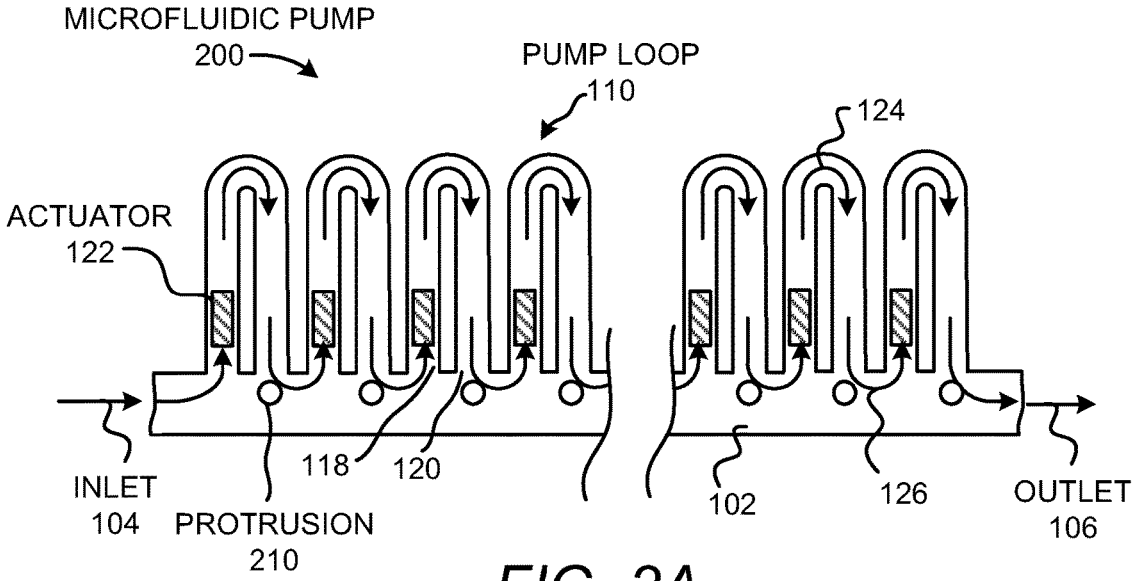
FIGS. 2A-2C, respectively, show simplified block diagrams of additional example microfluidic pumps.
Figure 2B:
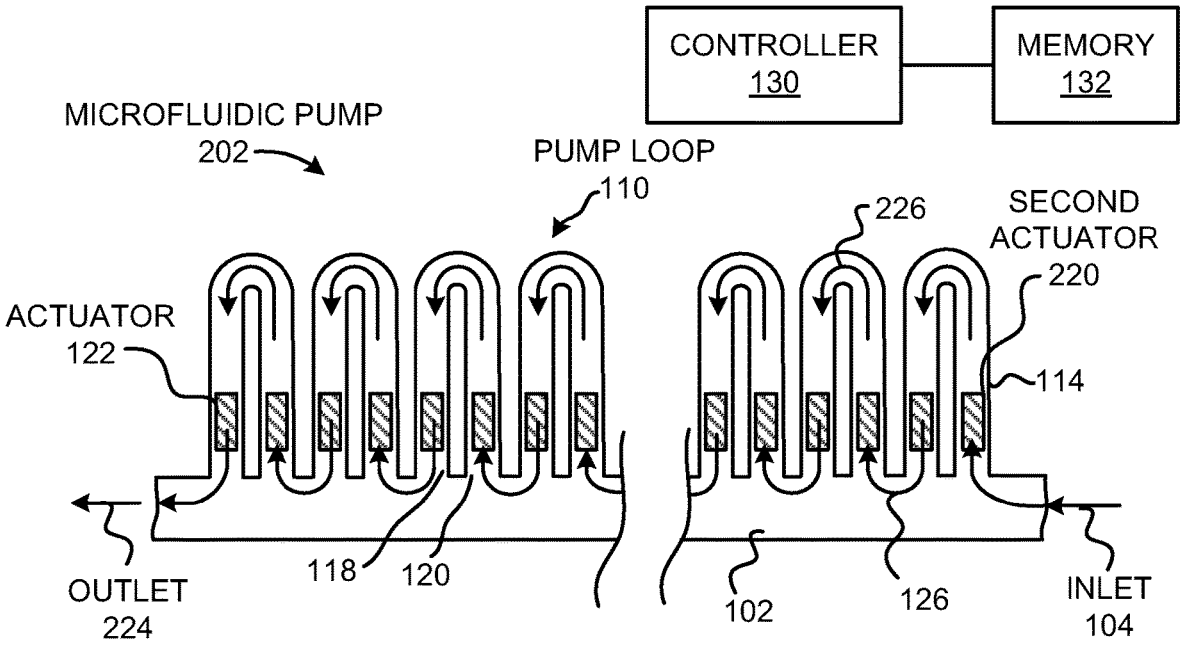
Figure 2C:
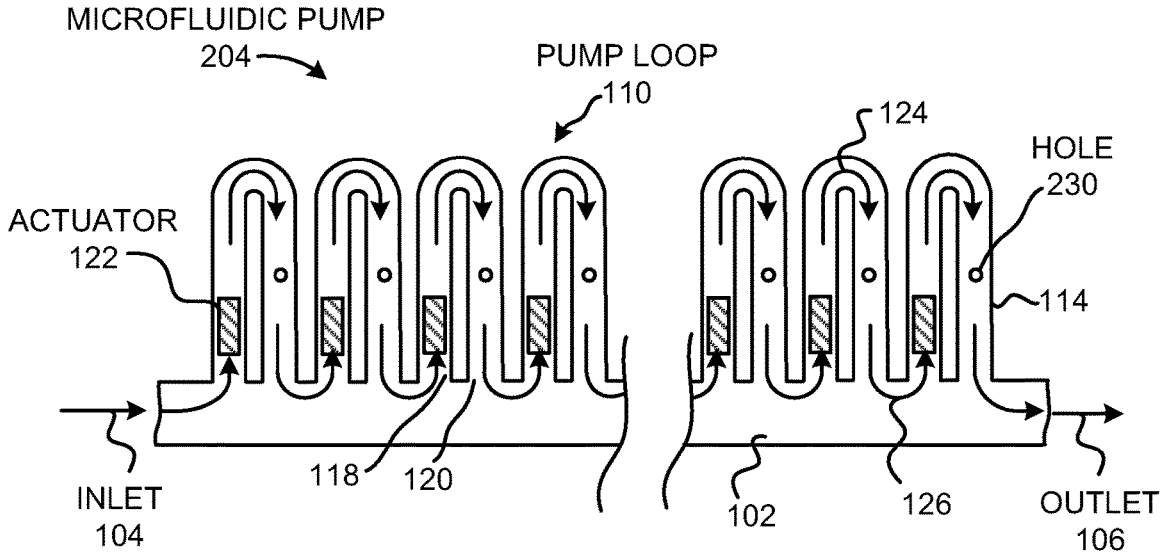

Turning now to FIGS. 2A-2C, there are respectively shown simplified block diagrams of additional example microfluidic pumps 200-204. The microfluidic pumps 200-204 depicted in FIGS. 2A-2C include many of the same features as those discussed above with respect to the microfluidic pump 100 depicted in FIG. 1. As such, only those features that differ will be described in detail with respect to the microfluidic pumps 200-204 depicted in FIGS. 2A-2C.

As shown in FIG. 2A, the microfluidic pump 200 may include a plurality of protrusions 210 that may extend the thickness, e.g., in a direction extending into the plane of the figure, of the transport channel 102. The protrusions 210 may equivalently be termed posts, pillars, obstructions, or the like, and may be formed of the same material or materials as the microfluidic pump 200. In any regard, the protrusions 202 may be positioned in the transport channel 102 to facilitate fluid flow from the second opening 120 of one pump loop 110 to the first opening 118 of an adjacent pump loop 110, e.g., next pump loop 110 in a flow direction of the transport channel 102.

According to an example, and as shown in FIG. 2A, the protrusions 210 may be positioned adjacent to the second openings 120 of the pump loops 110. In other examples, however, the protrusions 210 may symmetrically or asymmetrically be shifted toward the first openings 118 of the pump loops 110 to improve an effect of uni-directionality of the traveling wave through the microfluidic pump 200. The protrusions 210 are also depicted in FIG. 2A as having circular cross-sections. However, in other examples, the protrusions 210 have other cross-sectional shapes, e.g., oval, rectangular, triangular, or the like. Additionally, some of the protrusions 210 may have different shapes with respect to each other.

As shown in FIG. 2B, the microfluidic pump 202 may include a plurality of second actuators 220 positioned in the second branches 114 of the pump loops 110. In the example shown in FIG. 2B, the second actuators 220 may be activated to cause the fluid to be transported in the opposite direction from the direction shown in FIGS. 1 and 2A. That is, activation of the second actuators 220 may cause fluid to be transported through the pump loops 110 from an inlet 222 to an outlet 224 by causing the fluid to flow through the pump loops 110 as shown by the arrows 226. In one regard, by including the second actuators 220, the flow of fluid through the microfluidic pump 202 may be reversible such that a traveling wave may be formed to move in the opposite direction of the traveling wave in FIGS. 1 and 2A.

Although not shown, the protrusions 210 depicted in the microfluidic pump 200 shown in FIG. 2A may also be provided in the microfluidic pump 202 depicted in FIG. 2B.

As shown in FIG. 2C, the microfluidic pump 204 may include a plurality of holes 230 formed in the pump loops 110. For instance, the holes 230 may be formed on the second braches 114 of the pump loops 110. According to an example, the holes 230 may represent an additional microfluidic compliance feature and may modify the amplitude and resonance frequency of the travelling wave to improve transport efficiency through the pump loops 110. In any regard, the holes 230 may be of sufficiently small size to prevent fluid to flow out of the holes 230 but of sufficiently large size to modify the local compliance and change the amplitude and operation frequency of the travelling wave.

Although FIGS. 2A-2C are depicted as including various different features, it should be understood that the various features may be employed in a microfluidic pump 202-204. For instance, the microfluidic pump 204 depicted in FIG. 2C may also include the protrusions 210 depicted in the microfluidic pump 200 in FIG. 2A. Likewise, the microfluidic pump 204 depicted in FIG. 2C may also include the second actuators 220 depicted in the microfluidic pump 202 in FIG. 2B.

Figure 3:
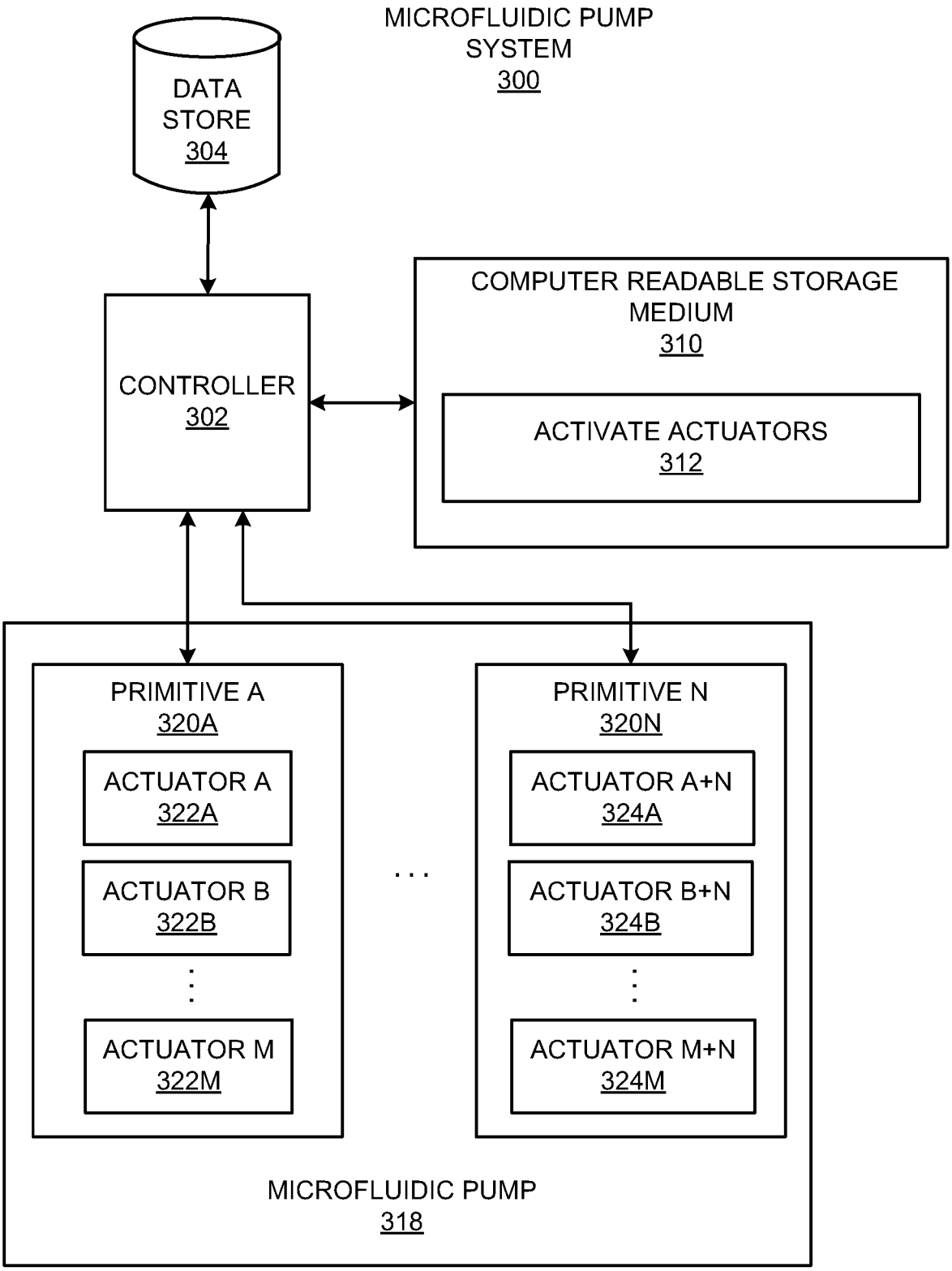
FIG. 3 shows a simplified block diagram of an example microfluidic pump system.

With reference now to FIG. 3, there is shown a simplified block diagram of an example microfluidic pump system 300. It should be understood that the microfluidic pump system 300 depicted in FIG. 3 may include additional components and that some of the components described herein may be removed and/or modified without departing from a scope of the microfluidic pump system 300 disclosed herein.

The microfluidic pump system 300 is shown as including a controller 302 and a data store 304. The controller 302 may be the same as the controller 130 depicted in and described above with respect to FIG. 1. The controller 302 may thus be a computing device, a semiconductor-based microprocessor, a central processing unit (CPU), an application specific integrated circuit (ASIC), a programmable logic device (PLD), and/or other hardware device. The controller 302 may also receive power from a power source or a power supply (not shown). The data store 304 may be Random Access Memory (RAM), an Electrically Erasable Programmable Read-Only Memory (EEPROM), a storage device, an optical disc, or the like.

The microfluidic pump system 300 may also include a computer readable storage medium 310, which may be equivalent to the memory 132 depicted in FIG. 1. The computer readable storage medium 310 may have stored thereon machine readable instructions 312 that the controller 302 may execute. More particularly, the controller 302 may fetch, decode, and execute instructions 312 to activate actuators. As an alternative or in addition to retrieving and executing instructions, the controller 302 may include one or more electronic circuits that include components for performing the functionalities of the instructions 312.

The computer readable storage medium 310 may be any electronic, magnetic, optical, or other physical storage device that contains or stores executable instructions. Thus, the computer readable storage medium 310 may be, for example, Random Access Memory (RAM), an Electrically Erasable Programmable Read-Only Memory (EEPROM), a storage device, an optical disc, and the like. The computer readable storage medium 310 may be a non-transitory machine-readable storage medium, where the term "non-transitory" does not encompass transitory propagating signals.

The microfluidic pump system 300 may further include a microfluidic pump 318 containing a plurality of actuators 322*a*-322*m* and 324*a*-324*m*, in which the variable "m" represents an integer value greater than one. The microfluidic pump 318 may be equivalent to any of the microfluidic pumps depicted in FIGS. 1 and 2A-2C. Likewise, the actuators 322*a*-322*m* and 324*a*-324*m* may be equivalent to the actuators 122 and/or the second actuators 220 discussed above in FIGS. 1 and 2A-2C. The controller 302 may activate the actuators 322*a*-322*m* and 324*a*-324*m* based upon the instructions 312 to activate the actuators and cause fluid to be transported through a transport channel 102 of the microfluidic pump 318.

According to an example, the actuators 322*a*-322*m* and 324*a*-324*m* may be grouped into respective primitives 320*a*-320*n*, in which the variable "n" represents an integer value greater than one and may be less than the variable "m". Each of the primitives 320*a*-320*n* may include actuators that are spaced apart by a predefined distance from each other. For instance, a first primitive 320*a* may include the first actuator 322*a*, the fifth actuator, etc., along the extent of the transport channel 102 and the second primitive 320*n* may include the second actuator, the sixth actuator, etc., along the extent of the transport channel 102. The grouping of the actuators 322*a*-322*m* and 324*a*-324*m* into primitives 320*a*-320*n* may enable the controller 302 to output a smaller number of activation signals in order to cause the fluid to be transported through the microfluidic pump 318.

According to an example, the controller 302, the data store 304, and the computer readable storage medium 310 may be integrated with the microfluidic pump 318, e.g., provided on a common chassis. In another example, the controller 302, the data store 304, and the computer readable storage medium 310 may be separate from the chassis on which the microfluidic pump 318 is provided. In the latter example, the controller 302, the data store 304, and the computer readable storage medium 310 may be part of a computing device, such as a smartphone, laptop computer, tablet computer, etc., and may interface with the microfluidic pump 318 through a wireless or wireless connection. In addition, in this example, the microfluidic pump 318 may have a power supply or may receive power from the computing device.

Figure 4:
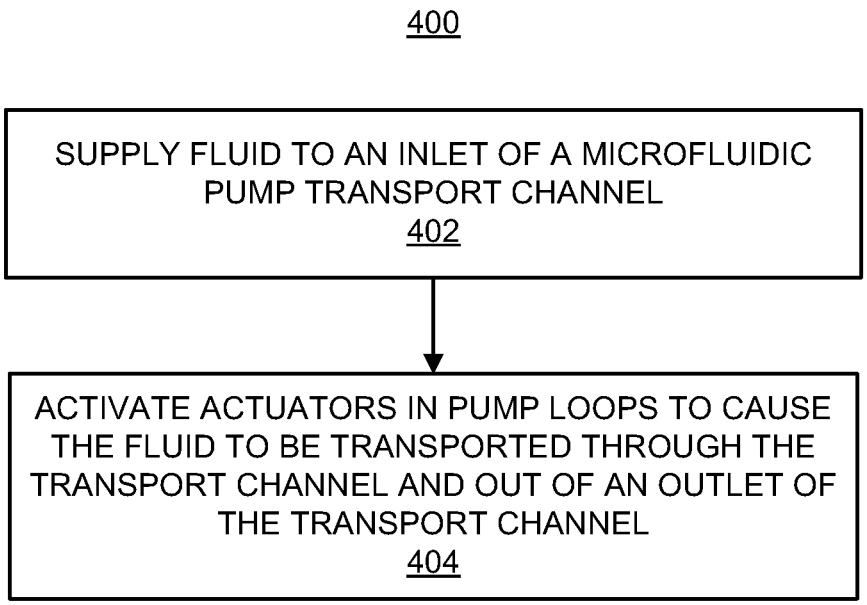
FIG. 4 shows a flow diagram of an example method for transporting a fluid through a microfluidic device.

Various manners in which the microfluidic pump system 300 may be implemented are discussed in greater detail with respect to the method 400 depicted in FIG. 4. Particularly, FIG. 4 depicts an example method 400 for transporting a fluid through a microfluidic device. It should be apparent to those of ordinary skill in the art that the method 400 may represent generalized illustrations and that other operations may be added or existing operations may be removed, modified, or rearranged without departing from the scope of the method 400.

The description of the method 400 is made with reference to the microfluidic pump system 300 illustrated in FIG. 3 for purposes of illustration. It should, however, be clearly understood that microfluidic pump systems having other configurations may be implemented to perform the method 400 without departing from the scope of the method 400.

At block 402, fluid may be supplied to an inlet 104 of a transport channel 102 of a microfluidic pump 318. The microfluidic pump 318 may also be termed a microfluidic device herein. As discussed herein, the microfluidic pump 318 may include the features shown in FIGS. 1 and 2A-2C. In addition, a sufficient amount of fluid may be supplied through the inlet 104 to fill the transport channel 102 and the pump loops 110 of the microfluidic pump 318.

At block 404, actuators 122 in the plurality of pump loops 110 may be activated to cause the fluid supplied into the transport channel 102 to be transported from the inlet 104, through the transport channel 102, and out of the outlet 106 of the transport channel. As discussed above, a controller 302 may execute the instructions 312 to activate the actuators 122 according to a predefined sequence that causes a traveling wave to be induced in the fluid through the transport channel 102 and the pump loops 110. That is, the induced traveling wave may cause the fluid to be transported from one end of the transport channel 102 to the other end of the transport channel 102.

According to an example, the actuators 122 are grouped into one of multiple primitives and the controller 302 may activate the actuators 122 in the respective primitives according to the predefined sequence.

According to an example in which the microfluidic pump 318 includes second actuators 220, for instance as shown in FIG. 2B, the controller 302 may control the actuators 122 and the second actuators 220 to cause the fluid to be transported in an opposite direction. That is, for instance, the controller 302 may cause the actuators 122 to cease being activated, e.g., by ceasing a supply of activation signals to the actuators 122. In addition, the controller 302 may supply activation signals to the second actuators 220 according to a predefined sequence to cause the second actuators 220 to form a traveling wave that moves in the opposite direction through the microfluidic pump 318 as compared with the traveling wave formed by the actuators 122.

Some or all of the operations set forth in the method 400 may be contained as programs or subprograms, in any desired computer accessible medium. In addition, the method 400 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A microfluidic device comprising:

a transport channel having an inlet and an outlet;

a plurality of pump loops extending along the transport channel, wherein each of the plurality of pump loops includes:

a first branch, a second branch, and a connecting section connecting the first branch and the second branch, wherein the first branch includes a first opening and the second branch includes a second opening, and wherein the first opening and the second opening are in direct fluid communication with the transport channel; and an actuator positioned in the first branch, and wherein the actuators in the plurality of pump loops are to be activated to induce a traveling wave that is to transport the fluid through the transport channel from the inlet to the outlet; and wherein each of the plurality of pump loops is enclosed except for the respective first opening and second opening.

2. The microfluidic device according to claim 1, wherein each of the plurality of pump loops does not include a nozzle.

3. The microfluidic device according to claim 1, wherein the actuators in the plurality of pump loops are grouped into respective primitives, and wherein all the actuators in a respective primitive are activated by a single instruction signal.

4. The microfluidic device according to claim 1, further comprising:

a plurality of protrusions positioned in the transport channel to facilitate fluid flow between adjacent pump loops.

5. The microfluidic device according to claim 4, wherein one of the plurality of protrusions is positioned adjacent to the second opening of each of the second branches to facilitate fluid flow into the first opening of an adjacent pump loop.

6. The microfluidic device according to claim 4, wherein each protrusion comprises a post made of a same material as the transport channel.

7. The microfluidic device according to claim 1, wherein each of the plurality of pump loops further comprises:

a second actuator positioned in the second branch; and wherein the second actuators in the plurality of pump loops are to be activated to induce a second traveling wave that is to transport the fluid through the transport channel from the outlet to the inlet.

8. The microfluidic device according to claim 1, wherein each of the plurality of pump loops has a dimension that is between about 10 micrometers and about 500 micrometers.

9. The microfluidic device according to claim 1, wherein the transport channel and pump loops are formed in a silicon material.

10. The microfluidic device according to claim 1, wherein the transport channel and pump loops are formed in an epoxy-based negative photoresist.

11. The microfluidic device according to claim 1, wherein a cross sectional area of each of the transport channel is larger than a cross sectional area of the pump loops.

12. The microfluidic device according to claim 1, wherein each of the plurality of pump loops includes a microfluidic compliance feature to modify an amplitude or resonance frequency of the traveling wave.

13. A method comprising:

supplying a fluid to an inlet of a transport channel of a microfluidic device, said microfluidic device comprising a plurality of pump loops, each of the plurality of pump loops including:

a first branch, a second branch, and a connecting section connecting the first branch and the second branch, wherein the first branch includes a first opening and the second branch includes a second opening, and wherein the first opening and the second opening are in direct fluid communication with the transport channel; and an actuator positioned in the first branch; and activating the actuators in the plurality of pump loops to induce a traveling wave that is to cause the fluid to be transported from the inlet, through the transport channel, and out of an outlet of the transport channel;

wherein the actuators in the plurality of pump loops are grouped into one of a first primitive and a second primitive and wherein activating the actuators further comprises alternatingly activating the actuators in the first primitive and the actuators in the second primitive.

14. The method according to claim 13, wherein each of the plurality of pump loops further comprises a second actuator positioned in the second branch, said method further comprising:

ceasing activation of the actuators in the first branches of the pump loops; and activating the second actuators in the plurality of pump loops to induce a second traveling wave that is to cause the fluid to be transported from the outlet, through the transport channel, and out of the inlet.

15. The method according to claim 13, further comprising using a plurality of protrusions positioned in the transport channel to facilitate fluid flow between adjacent pump loops.

16. A microfluidic system comprising:

a microfluidic transport channel having an inlet and an outlet;

an array of microfluidic loops arranged in fluid communication with and along the microfluidic transport channel, wherein each of the microfluidic loops do not include a nozzle, and wherein each of the microfluidic loops includes:

a first branch, a second branch, and a connecting section connecting the first branch and the second branch, wherein the first branch includes a first passage and the second branch includes a second passage, and wherein the first passage and the second passage are in direct fluid communication with the transport channel; and a pump positioned in the first branch;

a controller to activate the pumps in the plurality to microfluidic loops to induce a traveling wave that is to transport the fluid through the transport channel and the microfluidic loops; and a plurality of protrusions positioned in the microfluidic transport channel to facilitate fluid flow between adjacent loops in the array of microfluidic loops.

17. The microfluidic system of claim 16, wherein each of the plurality of microfluidic loops includes a hole to modify an amplitude and operation frequency of the traveling wave, wherein the hole is positioned on the second branch.

18. The microfluidic system of claim 16, wherein the pumps in the plurality of microfluidic loops are grouped into a plurality of primitives, and wherein the controller is to sequentially activate the plurality of primitives.

19. The microfluidic system of claim 16, wherein each protrusion comprises a post made of a same material as the transport channel.

20. The microfluidic system of claim 16, wherein each of the plurality of microfluidic loops does not include an opening from which fluid may be ejected except for the respective first opening and second opening.

* * * * *